US011542119B2

(12) United States Patent
Rebillard et al.

(10) Patent No.: US 11,542,119 B2
(45) Date of Patent: Jan. 3, 2023

(54) ELEVATOR ACCESS SYSTEMS FOR ELEVATORS

(71) Applicant: Otis Elevator Company, Farmington, CT (US)

(72) Inventors: Pascal Rebillard, Gien (FR); Gerard Sirigu, Gien (FR); Sebastien Bourdarias, Montargis (FR); Valerie Mauguen, Sully sur Loire (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 1203 days.

(21) Appl. No.: 16/039,439

(22) Filed: Jul. 19, 2018

(65) Prior Publication Data

US 2019/0023526 A1 Jan. 24, 2019

(30) Foreign Application Priority Data

Jul. 24, 2017 (EP) ..... 17305985

(51) Int. Cl.

| | |
|---|---|
| ***B66B 1/34*** | (2006.01) |
| ***B66B 13/16*** | (2006.01) |
| ***B66B 5/00*** | (2006.01) |
| ***B66B 1/28*** | (2006.01) |
| ***B66B 9/00*** | (2006.01) |

(52) U.S. Cl.

CPC ..... *B66B 1/3407* (2013.01); *B66B 1/28* (2013.01); *B66B 5/0018* (2013.01); *B66B 5/0043* (2013.01); *B66B 5/0087* (2013.01); *B66B 9/00* (2013.01); *B66B 13/16* (2013.01); *B66B 13/165* (2013.01)

(58) Field of Classification Search

CPC ... B66B 5/0087; B66B 5/0043; B66B 13/165; B66B 13/16

See application file for complete search history.

(56) References Cited

U.S. PATENT DOCUMENTS

| | | | | |
|---|---|---|---|---|
| 6,405,834 | B1 * | 6/2002 | Chida | B66B 11/001 187/391 |
| 7,237,655 | B2 | 7/2007 | Kocher | |
| 7,650,971 | B2 | 1/2010 | Pillin et al. | |
| 9,573,791 | B2 | 2/2017 | Garcia | |

(Continued)

FOREIGN PATENT DOCUMENTS

| | | |
|---|---|---|
| CN | 1747885 A | 3/2006 |
| CN | 202464974 U | 10/2012 |
| CN | 202988503 U | 6/2013 |

(Continued)

OTHER PUBLICATIONS

European Search Report, EP Application No. 17305985.8, dated Jan. 31, 2018, European Patent Office; EP Search Report 16 pages.

*Primary Examiner* — Diem M Tran
(74) *Attorney, Agent, or Firm* — Cantor Colburn LLP

(57) ABSTRACT

Elevator access systems having an access control module operably connected to an elevator system and an access device located within the access control module and removable therefrom, wherein when the access device is within the access control module a normal mode of operation of the elevator system is activated and when the access device is removed from the access control module, the elevator system enters a safety mode of operation.

18 Claims, 5 Drawing Sheets

(56) References Cited

U.S. PATENT DOCUMENTS

| | | | |
|---|---|---|---|
| 2015/0321882 | A1 | 11/2015 | Pursiainen et al. |
| 2017/0137258 | A1 | 5/2017 | Kleine, Jr. et al. |

FOREIGN PATENT DOCUMENTS

| | | | | | |
|---|---|---|---|---|---|
| CN | 103274269 | A | | 9/2013 | |
| CN | 204873298 | U | | 12/2015 | |
| CN | 105668391 | | | 6/2016 | |
| CN | 206156499 | U | | 9/2016 | |
| EP | 1471028 | A1 | | 10/2004 | |
| EP | 1728754 | | | 12/2006 | |
| EP | 1863733 | | | 12/2007 | |
| EP | 2072450 | A1 | | 6/2009 | |
| EP | 2229335 | A1 | | 9/2010 | |
| EP | 2941399 | | | 11/2015 | |
| JP | H10338429 | A | | 12/1998 | |
| JP | 2006264841 | A | | 10/2006 | |
| JP | 2009249821 | A | | 10/2009 | |
| JP | 2010280457 | A | | 12/2010 | |
| JP | 2012218834 | | | 11/2012 | |
| JP | 2016037326 | A | | 3/2016 | |
| KR | 20060036381 | A | | 4/2006 | |
| WO | 03086935 | A1 | | 10/2003 | |
| WO | WO-2014106682 | A1 | * | 7/2014 | ..... B66B 13/02 |
| WO | WO-2014124779 | A1 | * | 8/2014 | ..... B66B 13/22 |
| WO | 2016092337 | | | 6/2016 | |
| WO | 2016178047 | A1 | | 11/2016 | |
| WO | 2016178050 | A1 | | 11/2016 | |
| WO | 2016207683 | A1 | | 12/2016 | |
| WO | 2017009678 | A1 | | 1/2017 | |

* cited by examiner

ELEVATOR ACCESS SYSTEMS FOR ELEVATORS

Cross Reference to Related Applications

This application claims the benefit of European Application No. 17305985.8, filed Jul. 24, 2017, which is incorporated herein by reference in its entirety.

BACKGROUND

The subject matter disclosed herein generally relates to elevator systems and, more particularly, to access systems and devices for locks and access to elevator shafts for elevator maintenance.

Elevator systems include locking mechanisms that are useable by mechanics, technicians, and other authorized persons. The locking mechanisms can be part of lintels or door columns or traps inside the car of the elevator systems and thus may be easily accessible by anyone. However, it may be required by safety regulations and/or advantageous to prevent access to and/or operation of the elevator locking mechanisms at certain times (e.g., when a technician or mechanic is performing a maintenance operation) or when authorized access is not proper. Accordingly, devices that prevent access to the elevator system locking mechanisms may be desirable.

SUMMARY

According to some embodiments, elevator access systems are provided. The elevator access systems include an access control module operably connected to an elevator system and an access device located within the access control module and removable therefrom, wherein when the access device is within the access control module a normal mode of operation of the elevator system is activated and when the access device is removed from the access control module, the elevator system enters a safety mode of operation.

In addition to one or more of the features described above, or as an alternative, further embodiments of the elevator access systems may include an access device housing within the access control module, wherein the access device housing is operably connected to an elevator safety chain, wherein the access device is housed within the access device housing, and when the access device is within the access device housing, the normal mode of operation is enabled.

In addition to one or more of the features described above, or as an alternative, further embodiments of the elevator access systems may include that removal of the access device from the access device housing breaks the elevator safety chain.

In addition to one or more of the features described above, or as an alternative, further embodiments of the elevator access systems may include that the access device is configured to unlock and lock a landing door lock of the elevator system.

In addition to one or more of the features described above, or as an alternative, further embodiments of the elevator access systems may include a landing door lock at a landing of the elevator system, wherein the landing door lock is arranged to secure the access device within the landing door lock when a landing door is opened.

In addition to one or more of the features described above, or as an alternative, further embodiments of the elevator access systems may include that the access control module is an emergency and inspection cabinet or control box of the elevator system.

In addition to one or more of the features described above, or as an alternative, further embodiments of the elevator access systems may include that the access device is a key.

According some embodiments, elevator systems are provided. The elevator systems include an elevator shaft with an elevator car moveable within the elevator shaft, a plurality of landings along the elevator shaft, each landing having a landing door, and an elevator access system as described herein In addition to one or more of the features described above, or as an alternative, further embodiments of the elevator systems may include an elevator controller configured to control operation of the elevator car between at least the normal mode of operation and the safety mode of operation.

In addition to one or more of the features described above, or as an alternative, further embodiments of the elevator systems may include that removal of the access device from the access control module triggers communication from the access control module to the elevator control to activate the safety mode of operation.

In addition to one or more of the features described above, or as an alternative, further embodiments of the elevator systems may include that the access control module is located at one of the plurality of landings.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1:
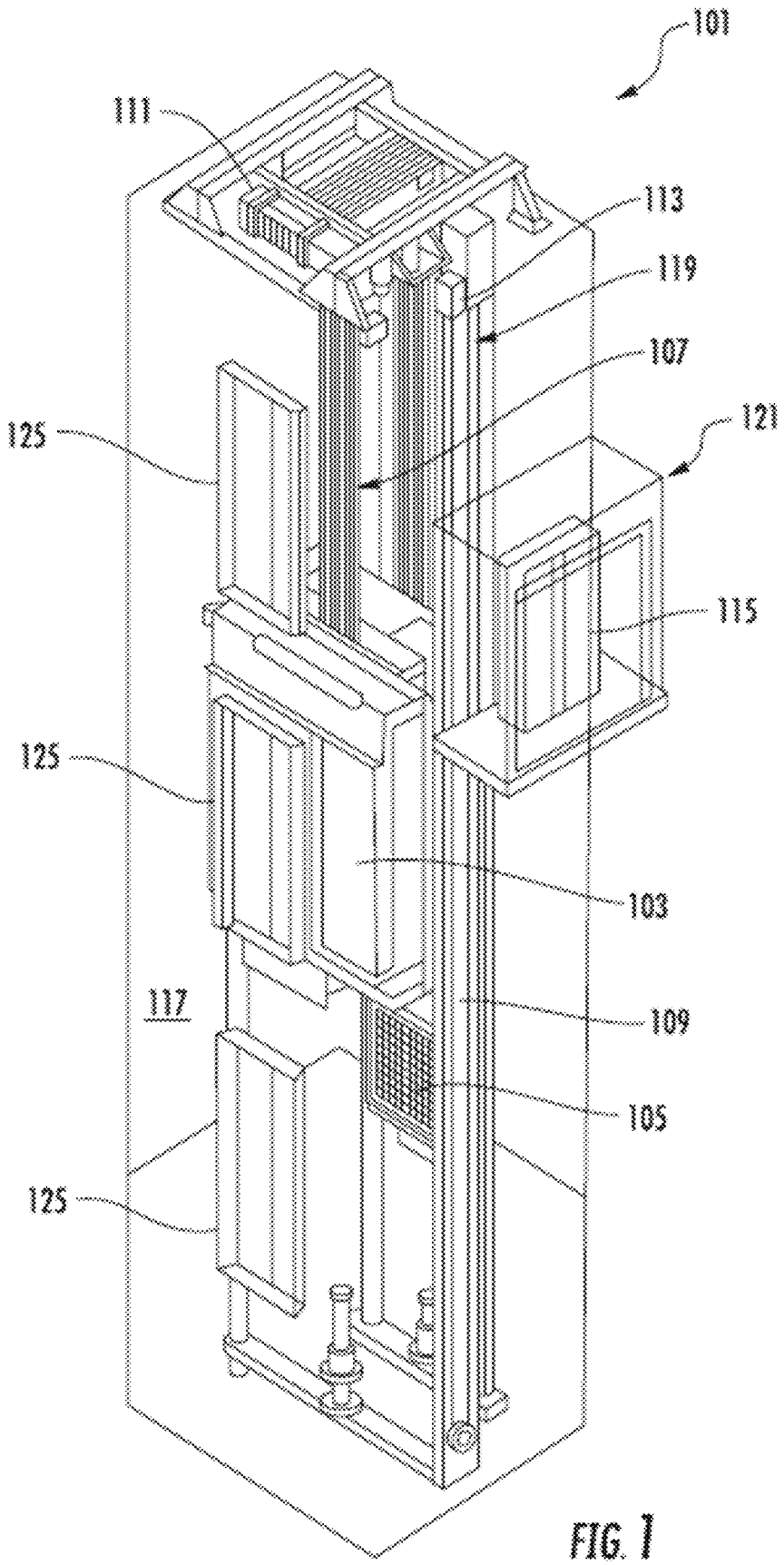
FIG. 1 is a schematic illustration of an elevator system that may employ various embodiments of the present disclosure.

FIG. 1 is a perspective view of an elevator system 101 including an elevator car 103, a counterweight 105, a roping 107, a guide rail 109, a machine 111, a position encoder 113, and an elevator controller 115. The elevator car 103 and counterweight 105 are connected to each other by the roping 107. The roping 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The roping 107 engages the machine 111, which, in this illustrative embodiment, is part of an overhead structure of the elevator system 101, although other arrangements are possible without departing from the scope of the present disclosure. The machine 111 is configured to control movement between the elevator car 103 and the counterweight 105. The position encoder 113 may be mounted on an upper sheave of a speed-governor system 119 and may be configured to provide position signals related to a position of the elevator car 103 within the elevator shaft 117. In other embodiments, the position encoder 113 may be directly mounted to a moving component of the machine 111, or may be located in other positions and/or configurations as known in the art.

The elevator controller 115 is located, as shown in the illustrative arrangement, in a controller room 121 of the elevator shaft 117 and is configured to control the operation of the elevator system 101, and particularly the elevator car 103. In other embodiments the controller 115 can be located in other locations, including, but not limited to, fixed to a landing or landing door or located in a cabinet at a landing. The elevator controller 115 may provide drive signals to the machine 111 to control the acceleration, deceleration, leveling, stopping, etc. of the elevator car 103. The elevator controller 115 may also be configured to receive position signals from the position encoder 113. When moving up or down within the elevator shaft 117 along guide rail 109, the elevator car 103 may stop at one or more landings 125 as controlled by the elevator controller 115. Although shown in a controller room 121, those of skill in the art will appreciate that the elevator controller 115 can be located and/or configured in other locations or positions within the elevator system 101.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor. Although shown and described with a roping system, elevator systems that employ other methods and mechanisms of moving an elevator car within an elevator shaft may employ embodiments of the present disclosure. FIG. 1 is merely a non-limiting example presented for illustrative and explanatory purposes.

Figure 2:
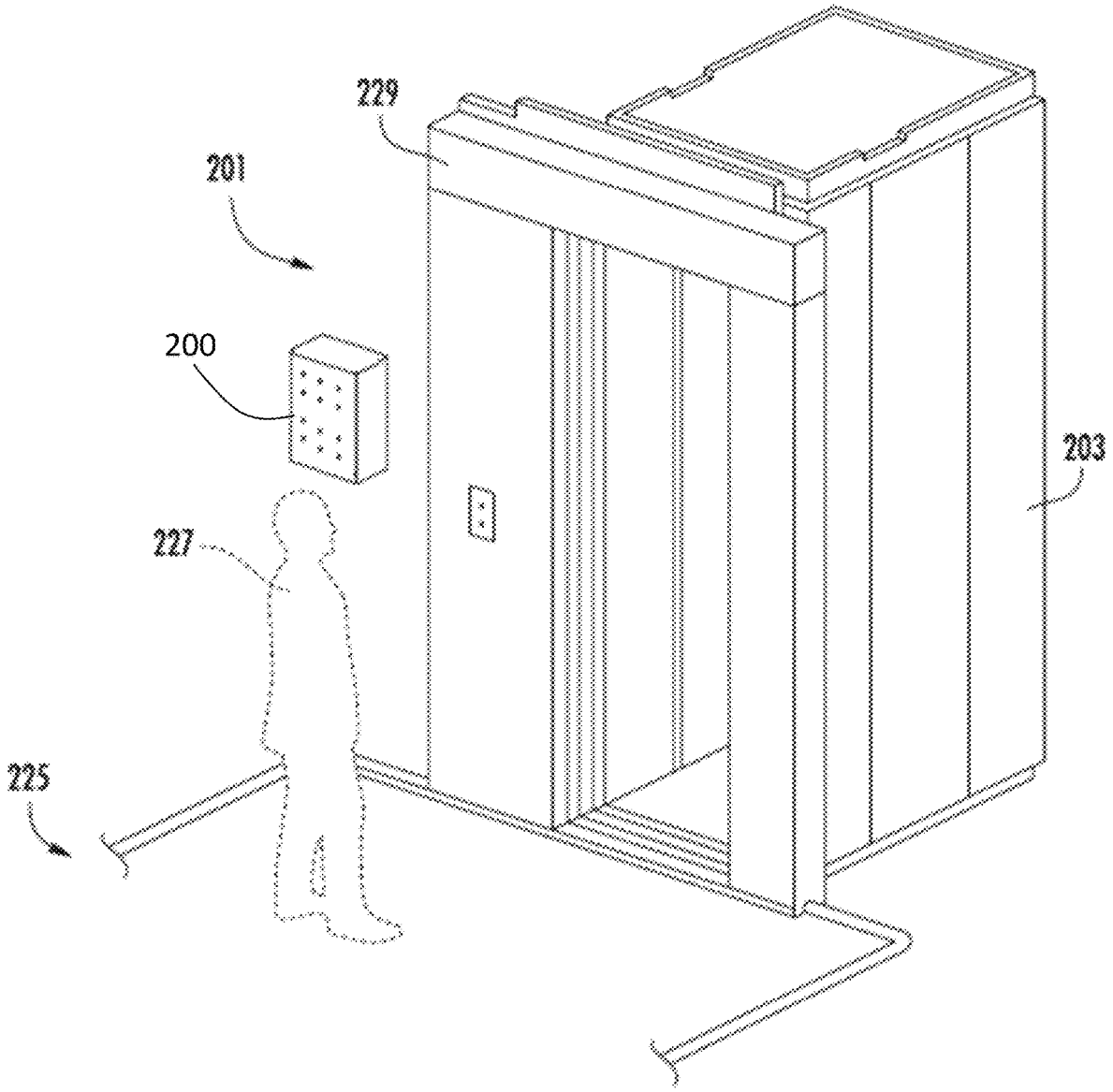
FIG. 2 is a schematic illustration of a landing floor of an elevator system with a hall call panel that may employ various embodiments of the present disclosure.

FIG. 2 is a schematic illustration of an elevator system 201 that may incorporate embodiments disclosed herein. As shown in FIG. 2, an elevator car 203 is located at a landing 225. The elevator car 203 may be called to the landing 225 by a passenger or mechanic 227 that desires to travel to another floor within a building or perform maintenance on a portion of the elevator system 201. In some situations, the mechanic 227 may wish to lock a feature of the elevator system, e.g., the elevator doors, an elevator trap, etc., such that the feature(s) cannot be opened or closed (e.g., to prevent unauthorized persons from accessing the elevator system 201 or portions thereof). For example, such situation may arise when the mechanic 227 wishes to access the elevator car and/or shaft to perform maintenance. Such control or locking can be achieved by a lock hole in a landing door lintel 229 of the elevator system 201 (which may be located at one or more landings 225). It may be advantageous to prevent unauthorized persons from accessing the lock and also enable access in a controlled manner. Accordingly, embodiments provided herein are directed to access systems and devices to enable locking/unlocking locks of elevator systems, the systems securely preventing unauthorized access to the locks of the elevator system.

For example, in some configurations, an access control module 200 (e.g., an emergency and inspection cabinet) can be located at one or more landings 225 of the elevator system. The access control module 200 can include one or more electrical and/or mechanical components that are configured to enable control of and/or access to an associated elevator system. For example, the access control module 200 can include a specialized or unique access key or tool ("access device") for a mechanic or other authorized person to lock and unlock various locks of the elevator system (e.g., lintel door locks, etc.). The access control module 200 can thus enable a mechanic or other authorized person (e.g., emergency personnel) to access an elevator shaft or car for various reasons (i.e., open landing doors).

Figure 3:
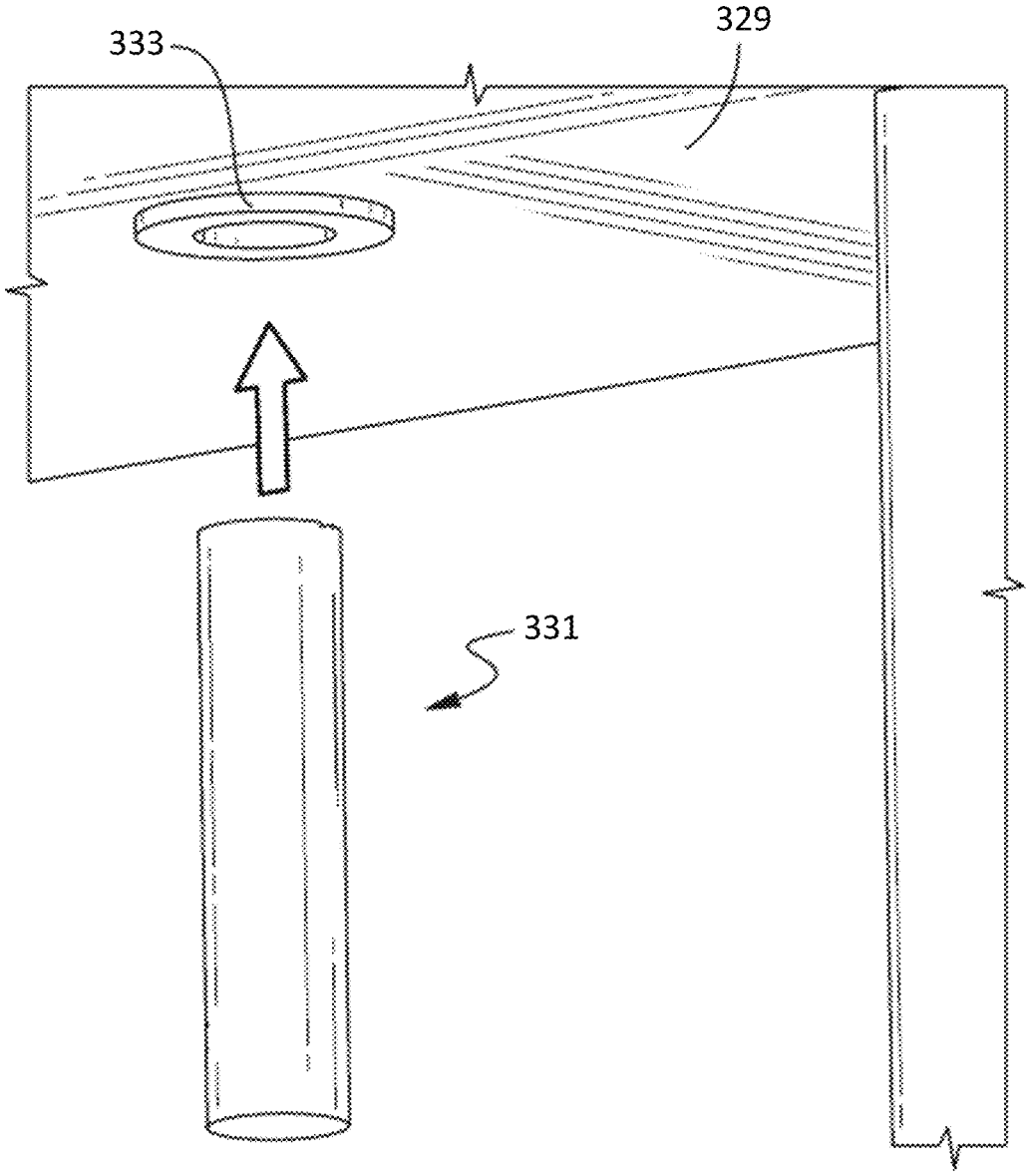
FIG. 3 is a schematic illustration of a lock of an elevator system that can incorporate embodiments of the present disclosure.

Turning to FIG. 3, an access device 331 for use with a lock 333 of an elevator system in accordance with an embodiment of the present disclosure is shown. Although shown and described herein as a key-type "access device," the term "access device" may refer to any access key, tool, or other mechanism that can be used to lock/unlock an elevator landing door. As shown, the lock 333 is an elevator door lock located within a landing door lintel 329 or landing door column of an elevator doorway. The access device 331 is configured to fit within an aperture or keyway of the lock 333. Those of skill in the art will appreciate that the locks and keys described herein are not limited to door locks, but rather may be employed in any locks of elevator systems. For example, in other configurations, the lock may be part of a door column or trap inside an elevator car or may be a lock of other parts of elevator systems. Thus, FIG. 3 is merely illustrative and not intended to be limiting. The lock 333 can include access prevention devices or mechanisms configured within the lock 333 to prevent the access device 331 from entering the aperture of the lock 333. The access device 331 is specifically designed for engagement and use with the specific lock 333.

As provided herein, embodiments of the present disclosure are directed to access devices that are arranged to disable or change an operating status of an elevator system when the access device is removed from an access control module or other type of cabinet or access device storage that is associated with the elevator system.

Figure 4:
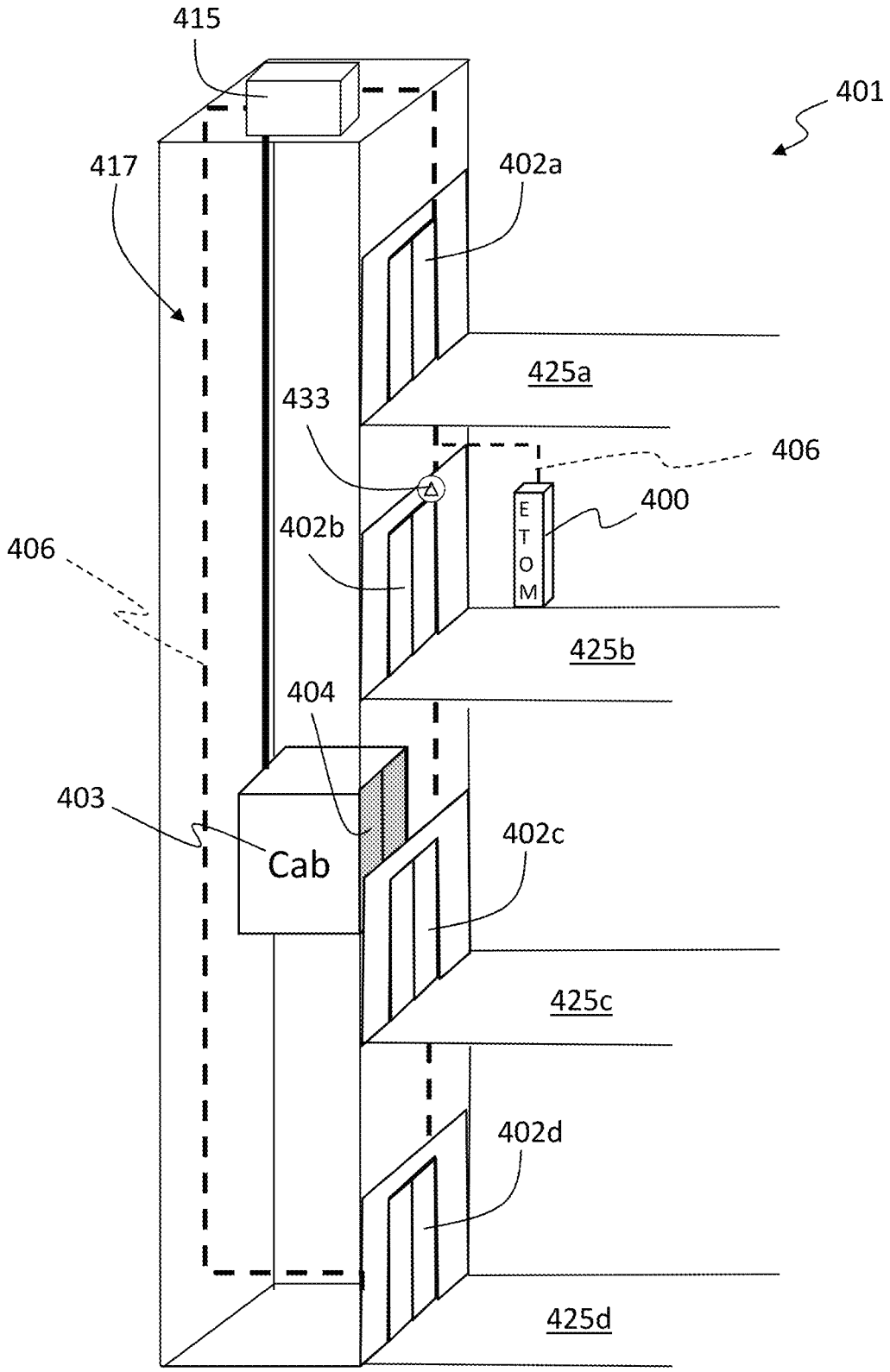
FIG. 4 is a schematic illustration of an elevator system in accordance with an embodiment of the present disclosure.

Turning now to FIG. 4, a schematic illustration of an elevator system 401 configured in accordance with a non-limiting embodiment of the present disclosure is shown. The elevator system 401 includes an elevator car 403 movable within an elevator shaft 417 between a plurality of landings 425*a*, 425*b*, 425*c*, 425*d*. The movement of the elevator car 403 is controlled by an elevator controller 415 (which can be part of an elevator machine or separate therefrom).

As shown, a first landing 425*a* is located at the top of the elevator shaft 417, a second landing 425*b* is located below the first landing 425*a*, a third landing 425*c* located below the second landing 425*b*, and a fourth landing 425*d* located below the third landing 425*c*. Although shown with four landings, FIG. 4 is merely provided for illustrative and explanatory purposes and any number of landings can be located along an elevator shaft, as will be appreciated by those of skill in the art.

The first landing 425*a* includes a respective first landing door 402*a*, the second landing 425*b* includes a respective second landing door 402*b*, the third landing 425*c* includes a respective third landing door 402*c*, and the fourth landing 425*d* includes a respective fourth landing door 402*d*. The landing doors 402*a*, 402*b*, 402*c*, 402*d* are configured to be openable only when the elevator car 403 is located at the respective landing door, as will be appreciated by those of skill in the art. That is, as will be appreciated by those of skill in the art, the landing doors 402*a*, 402*b*, 402*c*, 402*d* may be configured to operate through interaction with an elevator car door 404 of the elevator car 403.

In certain instances, such as for maintenance and/or in emergencies, access to the elevator shaft 417 through a landing door may be desirable or required. The elevator system 401 is equipped with an access control module 400 (e.g., emergency and inspection cabinet, control box, etc.). Within the access control module 400 is a specialized access device that is associated with landing door locks of the elevator system 401. The access control module 400 can be employed and accessed by a mechanic or other authorized person to obtain the access device therefrom.

As illustrated in FIG. 4, only the second landing 425*b* includes the access control module 400. An access device in accordance with embodiments of the present disclosure can be stored within the access control module, with the access device being usable with a lock 433 to open the landing door 402*a*. As illustratively shown, for simplicity, none of the other landings/landing doors 425*a*/402*a*, 425*c*/402*c*, 425*d*/402*d* include a lock. However, in some embodiments, any or all of the landings/landing doors can include locks that are openable with the access device stored within the access control module 400.

As shown, the access control module 400 is operably connected to a safety chain 406 of the elevator system 401. The safety chain 406 is connected to the elevator controller 415, as shown. A safety chain, as appreciated by those of skill in the art, is an electrical connection that connects various features and components of elevator systems to provide a safety feature. For example, a safety chain can be configured to change a state of operation of the elevator system if the safety chain is broken. That is, if a portion of the safety chain becomes disconnected, the elevator system can be shifted into an emergency and/or maintenance mode of operation (or some other restricted mode of operation), as will be appreciated by those of skill in the art.

In accordance with embodiments of the present disclosure, the access device within the access control module 400 is operably connected to the safety chain 406 of the elevator system 401. The system is arranged such that when the access device is removed from the access control module 400, the safety chain 406 is broken and the elevator system 401 enters a safety mode of operation. The safety mode of operation is an operating state of the elevator system 401 that can restrict various features of the elevator system, such as elevator travel speed, travel direction, ability to open landing doors, etc. With the access device removed from the access control module 400, the mechanic, emergency personnel, or other person can use the same access device to then unlock one of the landing doors 402*a*, 402*b*, 402*c*, 402*d*.

Figure 5A:
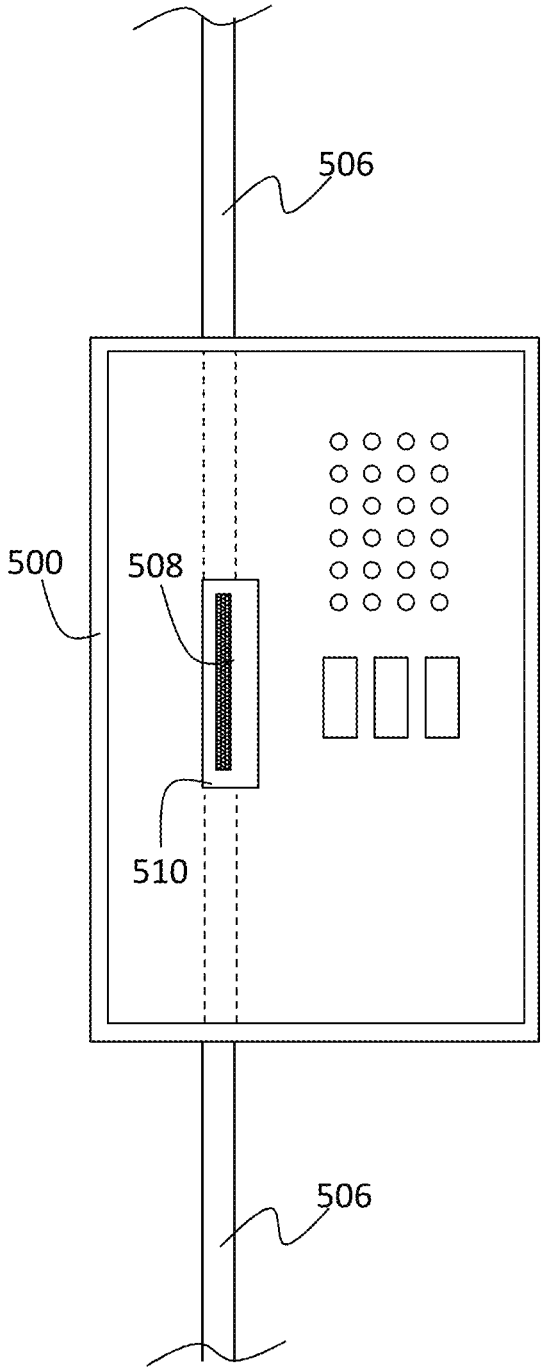
FIG. 5A is a schematic illustration of an access control module having an access device in accordance with an embodiment of the present disclosure.
Figure 5B:
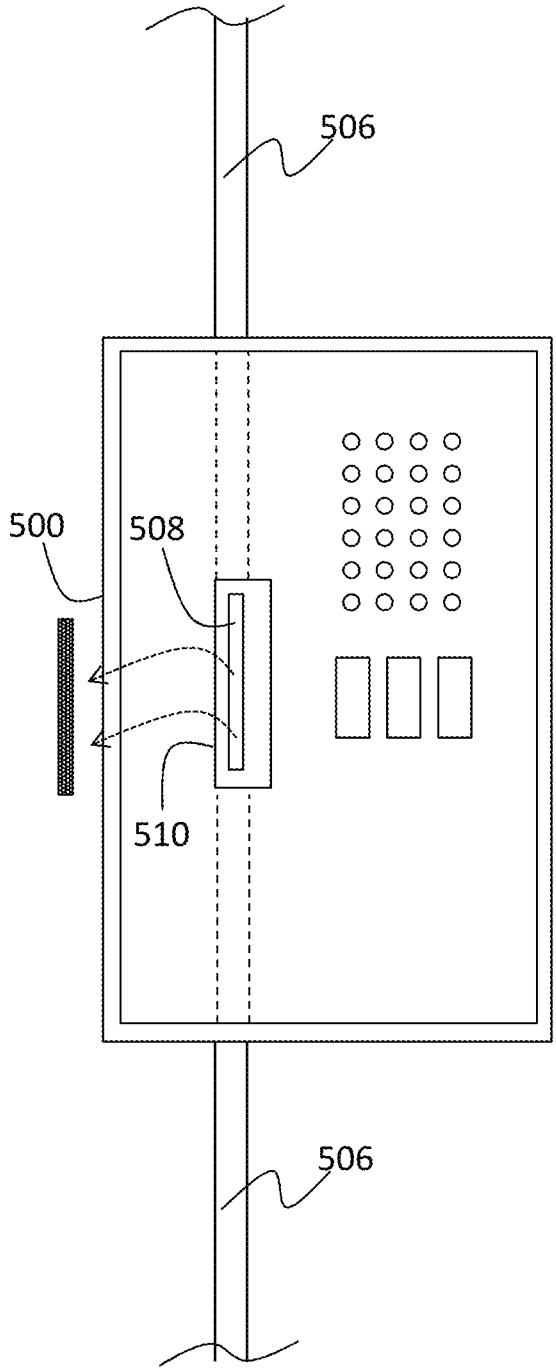
FIG. 5B is a schematic illustration showing the access control module of FIG. 5A with the access device removed therefrom.

Turning now to FIGS. 5A-5B, schematic illustrations of an access control module 500 in accordance with an embodiment of the present disclosure are shown. FIG. 5A illustrates a access device 508 within the access control module 500 and a complete or connected safety chain 506 and FIG. 5B illustrates the same access control module 500 but with the access device 508 removed therefrom, thus breaking the safety chain 506 and triggering or activating a safety mode of operation of an associated elevator system.

As shown the access control module 500 is connected to the safety chain 506 that is an electrical connection that connects various features and components of an elevator system. In this embodiment, the wiring of the safety chain 506 enters the access control module 500 and electrically connects to an access device housing 510. The access device housing 510 can hold the access device 508 as shown in FIG. 5A. The access device 508 provides an electrical connection or switch as part of the safety chain 506. Thus, when the access device 508 is removed from the access device housing 510 (FIG. 5B), the safety chain 506 is broken, which triggers activation of the safety mode of operation of the elevator system. By replacing the access device 508 within the access device housing 510, the safety chain 506 can be completed and thus a normal mode of operation can be resumed.

The access device 508 is configured to engage with a landing door lock to enable unlocking of an elevator door lock and thus enable access to an elevator shaft. Because the access device 508 is arranged as part of the safety chain 506, the only time an elevator landing door can be opened (i.e., using the access device 508) is when the elevator system is in the safety mode of operation. Accordingly, embodiments described herein provide an automatic activation of a safety mode of operation when it is desired to open an elevator landing door to gain access to an elevator shaft.

Although shown and described with the safety chain hardwired to the access control module, such arrangement is not to be limiting. For example, in some embodiments, removal of the access device from the access control module may trigger a command to be sent from the access control module to an elevator controller or machine to activate or trigger a safety mode of operation. In such embodiments, the removal of the access device may not break a safety chain but rather may communicate with one or more elements of the elevator system (e.g., controller) to engage or operate a safety mode of operation.

Advantageously, embodiments of the present provide an emergency or maintenance access capability to a landing door locking mechanism, enabling access the elevator shaft for performing maintenance and/or rescuing trapped passengers. Embodiments of the present disclosure include a specific access device (e.g., key or tool) fixed into an access control module (e.g., cabinet of a controller) located at a landing of the elevator system. The removal of the access device from the access control module will engage or activate a safety mode of operation of the elevator system. In some embodiments, the removal of the access device may place the elevator system "out of order." The safety mode of operation will remain active until the access device is returned to the access control module, even if the elevator system is repaired or a maintenance operation is completed (e.g., initial issue is solved and/or repaired).

In some embodiments, in addition to being tied to the safety chain or safety mode activation, the access device can configured to allow the unlocking of the landing doors thanks to a specific shape in the door lintel of a landing door. That is, in some embodiments, the access device/landing door lock combination may change from the typical triangular key arrangement, to provide additional safety/security to prevent unauthorized access to the elevator shaft. Further, in some embodiments, removal of the access device from the access control module and/or bringing the access device close to a lintel can make operational a keyway or opening to enable operation of the lock (e.g., electrically controlled/activated keyway access).

In some embodiments, the landing door lock and/or access device can be arranged such that when the access device is inserted into the keyway and the landing door is opened, the access device can be secured or prevented from removal from the keyway. As such, once the access device is inserted into the landing door lock and the landing door is opened, the access device cannot be removed therefrom (and thus cannot be replaced into the access control panel). Once the landing door is closed, the access device can be used to lock/secure the landing door in a closed position and then the access device can be removed from the lock. The access device can then be replaced or put back into the access control module to return the elevator system to a normal mode of operation.

Advantageously, embodiments provided herein enable automatic activation of a safety mode of operation of an elevator system when an access device for opening a landing door is removed from an access control module.

As used herein, the use of the terms "a," "an," "the," and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity).

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the spirit and scope of the present disclosure. Additionally, while various embodiments of the present disclosure have been described, it is to be understood that aspects of the present disclosure may include only some of the described embodiments.

Accordingly, the present disclosure is not to be seen as limited by the foregoing description, but is only limited by the scope of the appended claims.

What is claimed is:

1. An elevator access system comprising:

an access control module operably connected to an elevator system; and an access device located within the access control module and removable therefrom, wherein when the access device is within the access control module a normal mode of operation of the elevator system is activated and when the access device is removed from the access control module, the elevator system enters a safety mode of operation, wherein the access device is configured to unlock and lock a landing door lock of the elevator system.

2. The elevator access system of claim 1, further comprising an access device housing within the access control module, wherein the access device housing is operably connected to an elevator safety chain, wherein the access device is housed within the access device housing, and when the access device is within the access device housing, the normal mode of operation is enabled.

3. The elevator access system of claim 2, wherein removal of the access device from the access device housing breaks the elevator safety chain.

4. The elevator access system of claim 1, further comprising the landing door lock at a landing of the elevator system, wherein the landing door lock is arranged to secure the access device within the landing door lock when a landing door is opened.

5. The elevator access system of claim 1, wherein the access control module is an emergency and inspection cabinet or control box of the elevator system.

6. The elevator access system of claim 1, wherein the access device is a key.

7. An elevator system comprising:

an elevator shaft with an elevator car moveable within the elevator shaft;

a plurality of landings along the elevator shaft, each landing having a landing door; and an elevator access system comprising:

an access control module operably connected to the elevator system; and an access device located within the access control module and removable therefrom, wherein when the access device is within the access control module a normal mode of operation of the elevator system is activated and when the access device is removed from the access control module, the elevator system enters a safety mode of operation, wherein the access device is configured to unlock and lock a landing door lock of the elevator system.

8. The elevator system of claim 7, further comprising an elevator controller configured to control operation of the elevator car between at least the normal mode of operation and the safety mode of operation.

9. The elevator system of claim 8, wherein removal of the access device from the access control module triggers communication from the access control module to the elevator control to activate the safety mode of operation.

10. The elevator system of claim 7, wherein the access control module is located at one of the plurality of landings.

11. The elevator system of claim 7, further comprising an access device housing within the access control module, wherein the access device housing is operably connected to an elevator safety chain, wherein the access device is housed within the access device housing, and when the access device is within the access device housing, the normal mode of operation is enabled.

12. The elevator access system of claim 11, wherein removal of the access device from the access device housing breaks the elevator safety chain.

13. The elevator access system of claim 7, further comprising the landing door lock at a landing of the elevator system, wherein the landing door lock is arranged to secure the access device within the landing door lock when a landing door is opened.

14. The elevator system of claim 7, wherein the access control module is an emergency and inspection cabinet or control box of the elevator system.

15. The elevator system of claim 7, wherein the access device is a key.

16. An elevator access system comprising:

an access control module operably connected to an elevator system;

an access device located within the access control module and removable therefrom, wherein when the access device is within the access control module a normal mode of operation of the elevator system is activated and when the access device is removed from the access control module, the elevator system enters a safety mode of operation; and an access device housing within the access control module, wherein the access device housing is operably connected to an elevator safety chain, wherein the access device is housed within the access device housing, and when the access device is within the access device housing, the normal mode of operation is enabled, wherein removal of the access device from the access device housing breaks the elevator safety chain.

17. The elevator access system of claim 16, wherein the access control module is an emergency and inspection cabinet or control box of the elevator system.

18. The elevator access system of claim 16, wherein the access device is a key.

* * * * *